US011568839B2

(12) United States Patent
Arimoto et al.

(10) Patent No.: US 11,568,839 B2
(45) Date of Patent: Jan. 31, 2023

(54) PERFORMANCE SUPPORT DEVICE AND AIR REED INSTRUMENT

(71) Applicant: Yamaha Corporation, Hamamatsu (JP)

(72) Inventors: Keita Arimoto, Hamamatsu (JP); Masafumi Fuke, Hamburg (DE); Kazuhiro Fujita, Hamamatsu (JP); Akira Miki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 17/130,292

(22) Filed: Dec. 22, 2020

(65) Prior Publication Data

US 2021/0201859 A1 Jul. 1, 2021

(30) Foreign Application Priority Data

Dec. 25, 2019 (JP) ..... JP2019-234498

(51) Int. Cl.
*G10D 9/03* (2020.01)
*G10D 7/026* (2020.01)

(52) U.S. Cl.
CPC ..... *G10D 9/03* (2020.02); *G10D 7/026* (2013.01)

(58) Field of Classification Search
CPC ..... G10D 9/03; G10D 7/026; G10D 9/025; G10D 7/03
See application file for complete search history.

(56) References Cited

U.S. PATENT DOCUMENTS

| | | | | |
|---|---|---|---|---|
| 1,704,147 | A | 3/1929 | Paulson | |
| 2014/0013925 | A1* | 1/2014 | Clissold | G10D 9/02 84/384 |
| 2018/0033415 | A1* | 2/2018 | Yonezu | G10D 7/02 |

FOREIGN PATENT DOCUMENTS

| | | | | |
|---|---|---|---|---|
| DE | 102004023520 | A1 * | 12/2005 | G10D 9/026 |
| JP | 2017-68109 | A | 4/2017 | |
| JP | 2019-124836 | A | 7/2019 | |
| JP | 6744509 | B1 * | 8/2020 | G10D 9/02 |
| KR | 10-2010-0132472 | A | 12/2010 | |
| WO | WO 2012/131454 | A1 | 10/2012 | |

OTHER PUBLICATIONS

Extended European Search Report issued in European Application No. 20215492.8 dated May 19, 2021 (11 pages).

* cited by examiner

*Primary Examiner* — Kimberly R Lockett
(74) *Attorney, Agent, or Firm* — Crowell & Moring LLP

(57) ABSTRACT

A performance support device includes a first surface, a second surface, and a flow path. The first surface is configured to face a blow hole of an air reed instrument. The second surface is configured to be displaced from the blow hole. The flow path penetrates from the first surface to the second surface and that is configured to flow an exhaled breath toward the blow hole. A cross-sectional area of the flow path at the first surface is smaller than a cross-sectional area of the flow path at a position displaced from the first surface toward the second surface.

10 Claims, 7 Drawing Sheets

PERFORMANCE SUPPORT DEVICE AND AIR REED INSTRUMENT

CROSS-REFERENCE TO RELATED APPLICATIONS

Priority is claimed on Japanese Patent Application No. 2019-234498, filed Dec. 25, 2019, the contents of which are incorporated herein by reference.

BACKGROUND

Field of the Invention

This disclosure relates to a performance support device and an air reed instrument.

Description of Related Art

In air reed instruments such as flutes, transverse flutes, and shakuhachi flutes, in which a performer's exhaled breath is directly blown into a blow hole of the flute, it is necessary for a specific lip shape (embouchure) to be created and for the exhaled breath to be blown onto an edge of the blow hole at the time of playing. For this reason, it is difficult for performers such as beginners with poor playing skills to play this type of air reed instrument.

There are performance support devices (performance aids) that enable an air reed instrument to be played even by a beginner, and air reed instruments including the performance support devices. The performance support devices and the air reed instruments include a tubular flow path forming portion having a flow path for guiding a performer's exhaled breath into the blow hole.

SUMMARY

However, in the existing air reed instruments, which include a flow path forming portion, there is a problem that the timbre is significantly different to the timbre obtained when a performer's exhaled breath is directly blown to the blow hole without using a flow path forming portion (that is to say, the true timbre of the air reed instrument). This is thought to be because the cross-sectional area of the flow path of the flow path forming portion is constant from the inlet to the outlet, the shape of the flow path is significantly different to the shape of a performer's lips after forming an embouchure.

The present disclosure has been made in view of the circumstances described above. An example of an object of the embodiments of the present invention is to provide a performance support device which is capable of bringing the timbre of an air reed instrument closer to the true timbre irrespective of a performer's playing skill, and an air reed instrument including the performance support device.

According to a first aspect of the present invention, a performance support device includes: a first surface configured to face a blow hole of an air reed instrument; a second surface configured to be displaced from the blow hole than the first surface; and a flow path that penetrates from the first surface to the second surface and that is configured to flow a exhaled breath toward the blow hole. A cross-sectional area of the flow path at the first surface is smaller than a cross-sectional area of the flow path at a position displaced from the first surface toward the second surface.

According to a second aspect of the present invention, an air reed instrument includes: a head tube including a blow hole; and a performance support device provided in a vicinity of the blow hole. The performance support device includes: a first surface configured to face the blow hole; a second surface configured to be displaced from the blow hole than the first surface; and a flow path that penetrates from the first surface to the second surface and that is configured to flow a exhaled breath toward the blow hole. A cross-sectional area of the flow path at the first surface is smaller than a cross-sectional area of the flow path at a position displaced from the first surface toward the second surface.

Other objects, advantages and novel features of the embodiments of the present invention will become apparent from the following detailed description of one or more preferred embodiments when considered in conjunction with the accompanying drawings, in which:

DETAILED DESCRIPTION

Figure 1:
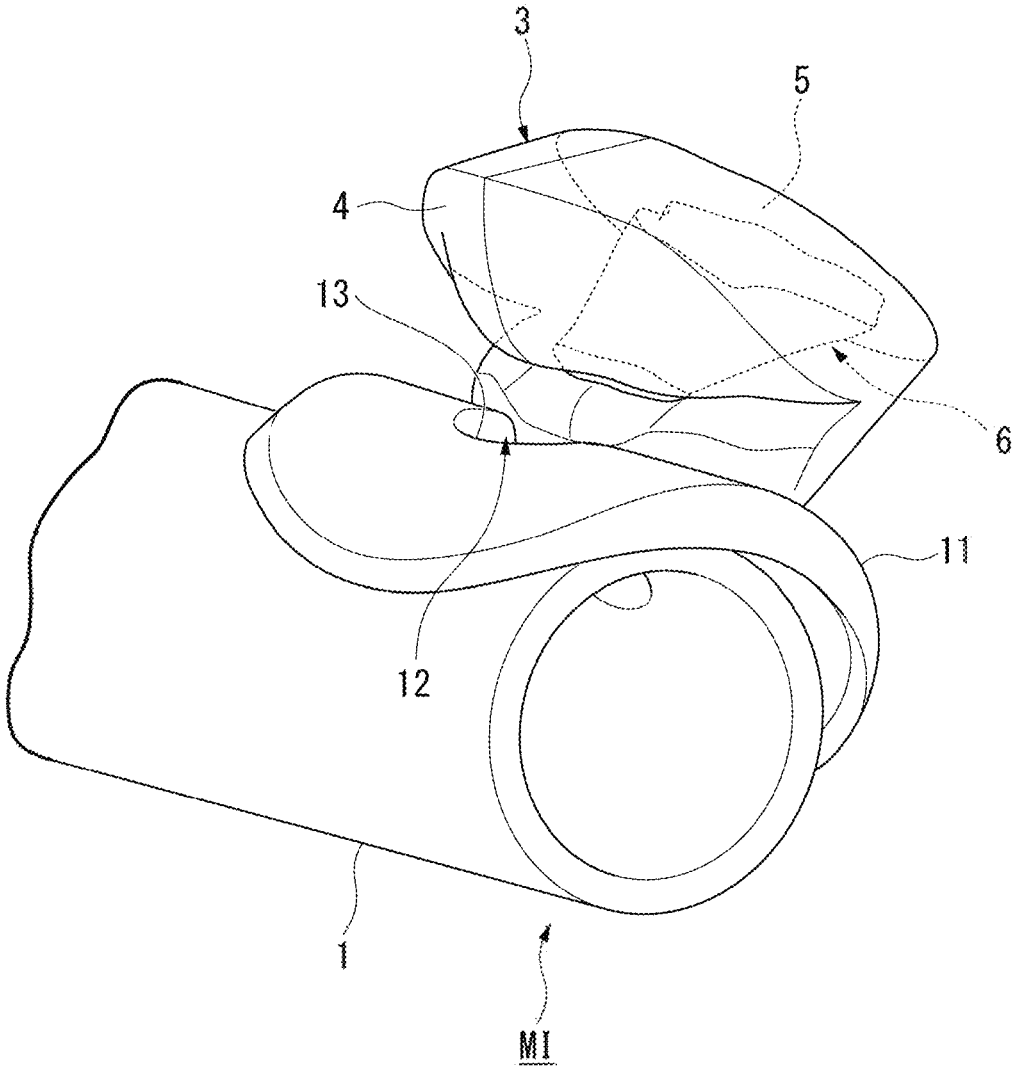
FIG. 1 is a perspective view showing the main parts of a flute including a performance support device (performance aid)
Figure 2:
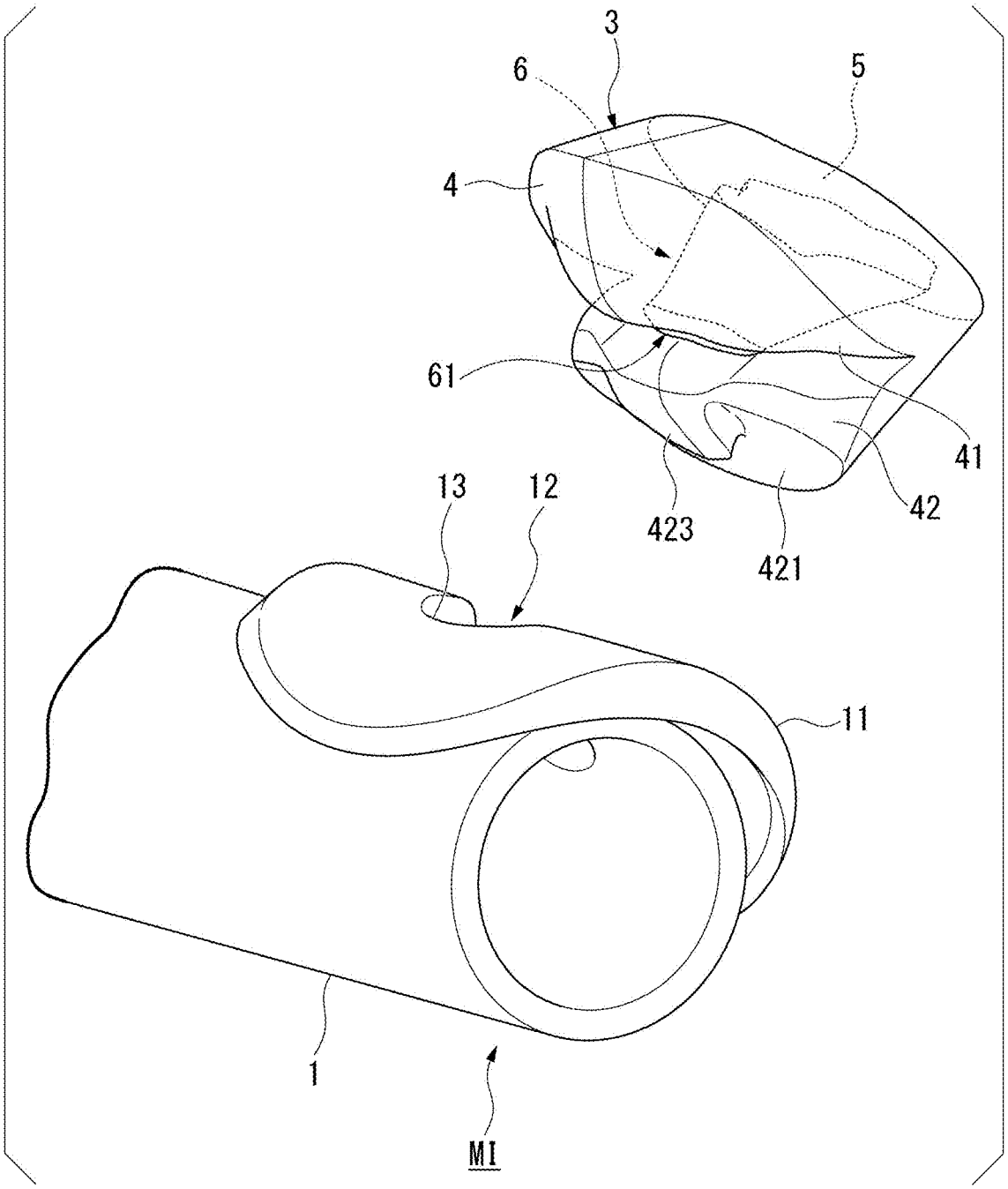
FIG. 2 is an exploded perspective view showing a state where the performance support device has been removed from the head tube of the flute in FIG. 1.

As shown in FIGS. 1 and 2, a flute MI is illustrated as an example of an air reed instrument. In FIGS. 1 and 2, only the head tube 1 of the flute MI is shown, and the main tube and the foot tube which include the keys are omitted.

Figure 7:
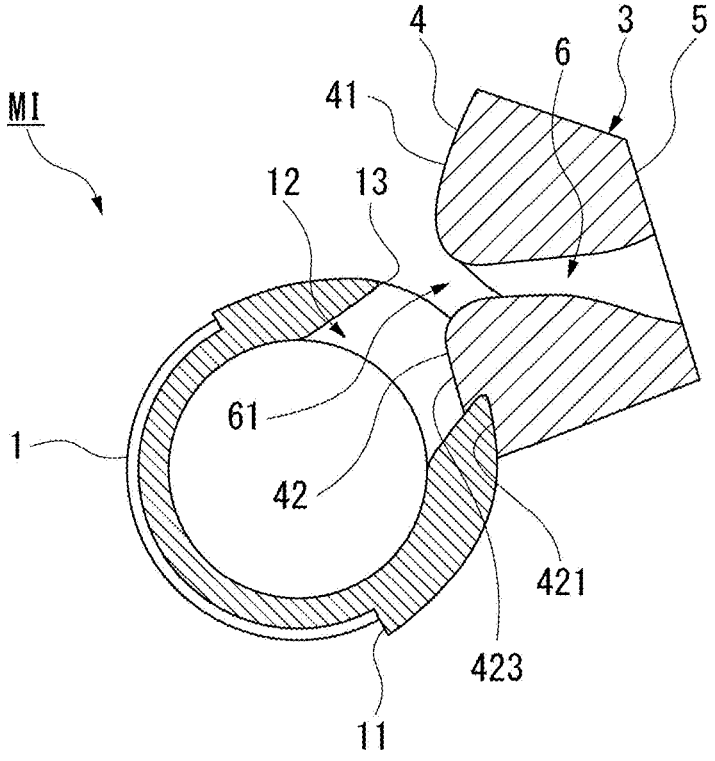
FIG. 7 is a cross-sectional view showing a flute including the performance support device.

As shown in FIGS. 1, 2, and 7, the head tube 1 of the flute MI includes a lip plate 11 against which the performer's lower lip is pressed. A blow hole 12 that extends from the inside to the outside of the head tube 1 is formed in the part of the head tube 1 that includes the lip plate 11. An edge 13, against which the performer's exhaled breath is blown, is formed on the peripheral surface of the blow hole 12 on the outer surface of the lip plate 11.

The flute MI includes a performance support device (performance aid) 3, which is provided in the vicinity of the blow hole 12 of the head tube 1, and guides the performer's exhaled breath to the blow hole 12. As shown in FIGS. 2 to 6, the performance support device 3 includes a first surface 4, a second surface 5, and a flow path 6.

The first surface 4 is a surface positioned on the blow hole 12 side of the flute MI. The first surface 4 may be formed in an arbitrary shape such as a flat surface. The first surface 4 is formed in a shape that imitates the surface of the lips exposed to the outside. The specific shape of the first surface 4 will be described later.

The second surface 5 is a surface positioned on the performer's lips (labial) side. The second surface 5 may be formed in an arbitrary shape. However, as described earlier, it is formed in a flat shape. The second surface 5 represents the opposite surface to the first surface 4 along the flow path 6.

The flow path 6 penetrates from the first surface 4 to the second surface 5. That is to say, the performance support device 3 is formed in a substantially tubular shape. The flow path 6 allows the performer's exhaled breath to flow toward the blow hole 12 of the flute MI.

The flow path 6 and the first surface 4 of the performance support device 3 are formed in a shape that imitates the performer's lips when the performer's exhaled breath is directly blown into the blow hole 12. First, the flow path 6, which imitates the complicated shape of the inner surface of the lips not exposed to the outside, will be described.

Figure 5:
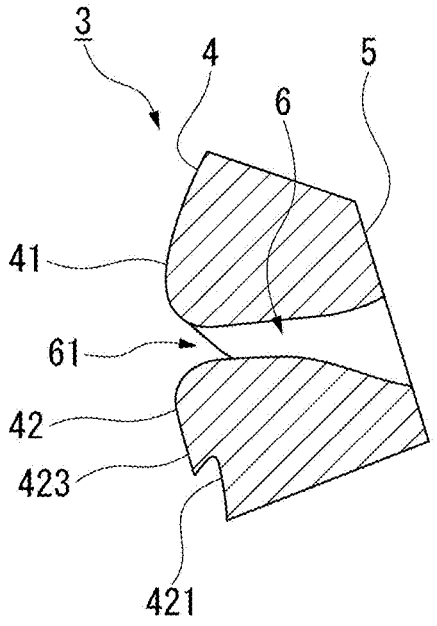
FIG. 5 is a cross-sectional view along arrows V-V in FIGS. 3 and 4.
Figure 6:
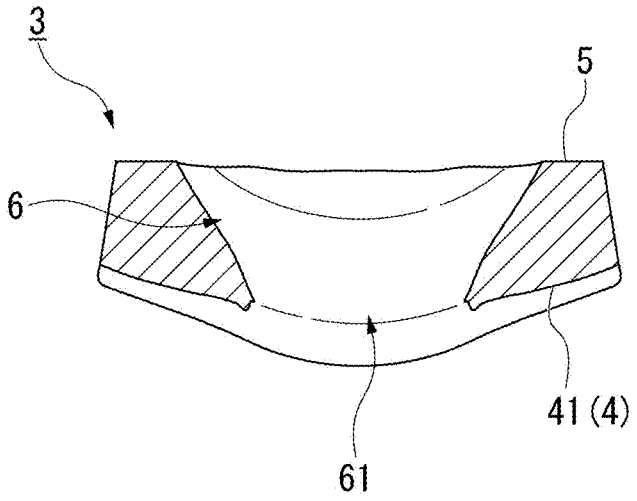
FIG. 6 is a cross-sectional view along arrows VI-VI in FIGS. 3 and 4.

As shown in FIGS. 2, 5, and 6, the cross-sectional area of the flow path 6 at the first surface 4 in a direction perpendicular to the penetration direction of the flow path 6 is smaller than the cross-sectional area of the flow path 6 at a position which is displaced from the first surface 4 toward the second surface 5 side. Specifically, the cross-sectional area of the flow path 6 is the smallest at the first surface 4, and the cross-sectional area of the flow path 6 is the largest at the second surface 5. Furthermore, the cross-sectional area of the flow path 6 continuously increases from the first surface 4 toward the second surface 5.

Figure 4:
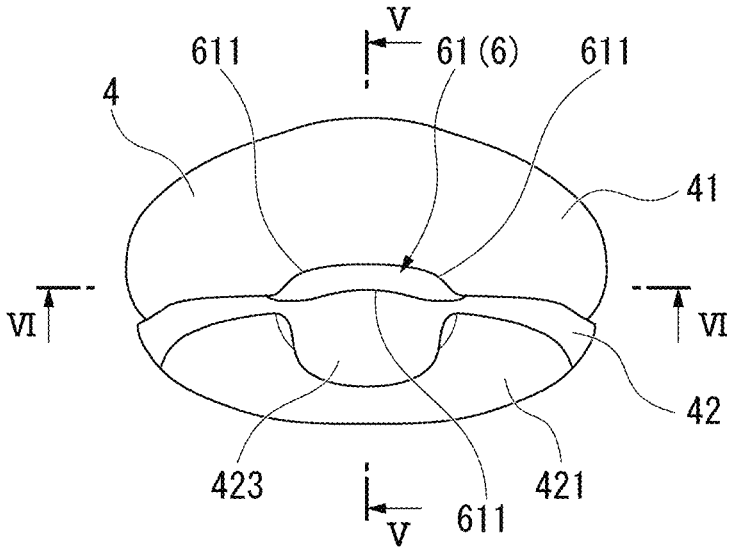
FIG. 4 is a diagram showing the performance support device in FIGS. 1 and 2 when viewed from a side of a first surface in which an opening of the flow path is formed.

As shown in FIG. 4, when viewed from the first surface 4 side, at least a portion of the edge of an opening portion 61 (hereinafter referred to as first opening portion 61) of the flow path 6 in the first surface 4 is curved. In FIG. 4, reference symbol 611 indicates a representative section of the edge of the first opening portion 61 of the flow path 6, which is curved.

Figure 3:
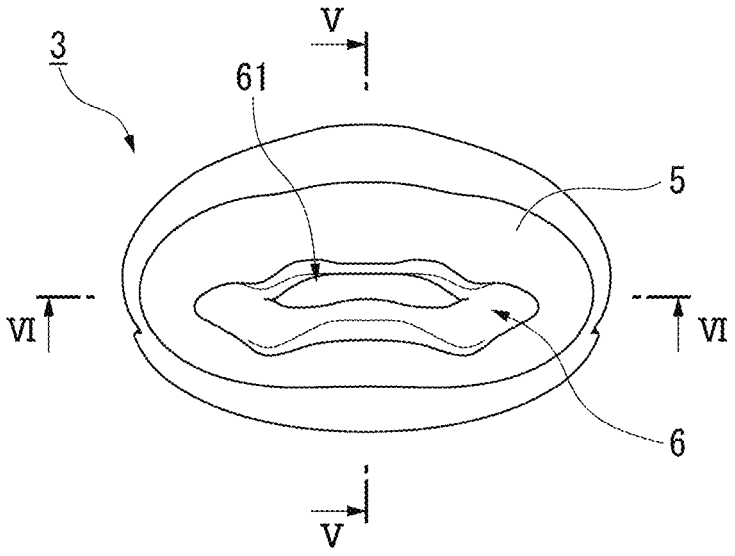
FIG. 3 is a diagram showing the performance support device in FIGS. 1 and 2 when viewed from a side of a second surface in which an opening of the flow path is formed.

As shown in FIGS. 2 to 4, the cross-sectional shape of the flow path 6 is flattened. Specifically, the width dimension in the width direction (the horizontal direction in FIGS. 3 and 4), which is perpendicular to the penetration direction of the flow path 6, is larger than the height dimension in the height direction (the vertical direction in FIGS. 3 and 4), which is perpendicular to the penetration direction and the width direction. That is to say, the cross-sectional shape of the flow path 6 is formed in a shape which is close to an oval shape or a rectangular shape. Furthermore, the flattened cross-sectional shape of the flow path 6 is substantially maintained from the first surface 4 until the second surface 5.

Next, the shape of the first surface 4, which imitates the outer surface of the performer's lips exposed to the outside, will be described.

As shown in FIGS. 2, 4, and 5, the first surface 4 has an upper lip area 41 and a lower lip area 42. The upper lip area 41 corresponds to the outer surface of the performer's upper lip. The lower lip area 42 corresponds to the outer surface of the performer's lower lip. The upper lip area 41 and the lower lip area 42 are formed as convex curved surfaces that each correspond to the upper lip and the lower lip. The upper lip area 41 and the lower lip area 42 are arranged side-by-side in the height direction of the flow path 6 (the vertical direction in FIGS. 4 and 5) mentioned above.

As shown in FIGS. 2, 4, 5, and 7, a first area 421 of the lower lip area 42 that makes contact with the lip plate 11 is formed recessed with respect to a second area 423 of the lower lip area 42, such that the first area 421 corresponds to the shape of the lower lip, which undergoes a deformation as a result of being pressed against the lip plate 11. Furthermore, a portion of the second area 423, which protrudes with respect to the first area 421, is arranged inside the blow hole 12 when the first area 421 makes contact with the lip plate 11 (in particular, see FIG. 7). The second area 423 is positioned between the first area 421 and the first opening portion 61 of the flow path 6.

The lower lip area 42 formed as described above reproduces the shape of the outer surface of the performer's lower lip when pressed against the lip plate 11.

Furthermore, in the performance support device 3 described earlier, as shown in FIG. 7, the first opening portion 61 of the flow path 6 is positioned so that the performer's exhaled breath that blows out from the first opening portion 61 is blown onto the edge 13 of the blow hole 12. Specifically, the first opening portion 61 of the flow path 6 is positioned in the above described manner by bringing the first area 421 of the performance support device 3 into contact with an area of the lip plate 11 positioned on the opposite side of the blow hole 12 from the edge 13, such that the longitudinal direction of the flow path 6 coincides with the direction heading from the first opening portion 61 toward the edge 13.

Moreover, the performance support device 3 is elastically deformable. The performance support device 3 may be formed of an elastic material such as silicone.

The specific size of the performance support device 3 and the shape of the outer surface of the performance support device 3 excluding the first surface 4 may be arbitrary. The performance support device 3 may be formed in a size that, for example, enables the performer using the performance support device 3 to grip the performance support device 3 by mouth.

The performance support device 3 is attached to the head tube 1 of the flute MI as a result of the first area 421 of the first surface 4 being brought into contact with the lip plate 11, and a portion of the second area 423 of the first surface 4 being inserted inside the blow hole 12, such that the first opening portion 61 of the flow path 6 faces the edge 13 of the blow hole 12.

Furthermore, the performance support device 3 is secured with respect to the head tube 1. The specific method of securing the performance support device 3 may be an arbitrary method such as adhesion, or securing by screws. The performance support device 3 may be detachably secured with respect to the head tube 1, or may be non-detachably secured.

When the performer plays the flute MI after attaching the performance support device 3, the performance support device 3 is gripped by the performer's lips and the performer's exhaled breath is blown into the flow path 6 from the second surface 5 side. As a result, the performer's exhaled breath is blown from the first opening portion 61 of the flow path 6 onto the edge 13 of the blow hole 12, and sound is emitted from the head tube 1.

According to the performance support device 3 and the flute MI including the performance support device 3, the cross-sectional area of the flow path 6 at the first surface 4 is smaller than the cross-sectional area of the flow path 6 at a position which is displaced from the first surface 4 toward the second surface 5 side. Consequently, the shape of the flow path 6 can be brought closer to the shape of the performer's lips when the performer's exhaled breath is directly blown to the blow hole 12 of the flute MI. As a result, it is possible to bring the timbre of the flute MI closer to the true timbre irrespective of the performer's playing skill.

Moreover, when the performer uses the performance support device 3 and plays the flute MI, the shape of the performer's lips is not limited compared to a typical performance method in which the performer's lips are brought into contact with the head tube 1 (lip plate 11). Therefore, playing methods such as flutter tonguing can be easily realized.

Furthermore, in the performance support device 3, the cross-sectional area of the flow path 6 continuously increases from the first surface 4 toward the second surface 5 side. In addition, at least a portion of the edge of the first opening portion 61 of the flow path 6 is curved. As a result, the shape of the flow path 6 can be brought closer to the shape of the performer's lips when the flute MI is played. Consequently, it is possible to bring the timbre of the flute MI even closer to the true timbre.

Further, the performance support device 3 has a shape that imitates (a shape that reproduces) the performer's lips when the performer's exhaled breath is directly blown to the blow hole 12 of the flute MI. Therefore, a sound can be produced which is substantially equivalent to the true timbre of the flute MI.

Moreover, in one example, the performance support device 3 is elastically deformable. Consequently, as a result of the performer pressing the performance support device 3 from the outside by biting or the like using their mouth (lips, teeth, etc.), the size and shape of the flow path 6 can be adjusted. This makes it possible to change the timbre of the flute MI. Therefore, the degree of freedom and expressiveness can be improved when performing with the flute MI.

Furthermore, in the performance support device 3, the cross-sectional area of the flow path 6 reaches a maximum at the second surface 5. Therefore, an advantageous effect is obtained in which the performer's exhaled breath can be easily blown into the flow path 6.

Figure 8A:
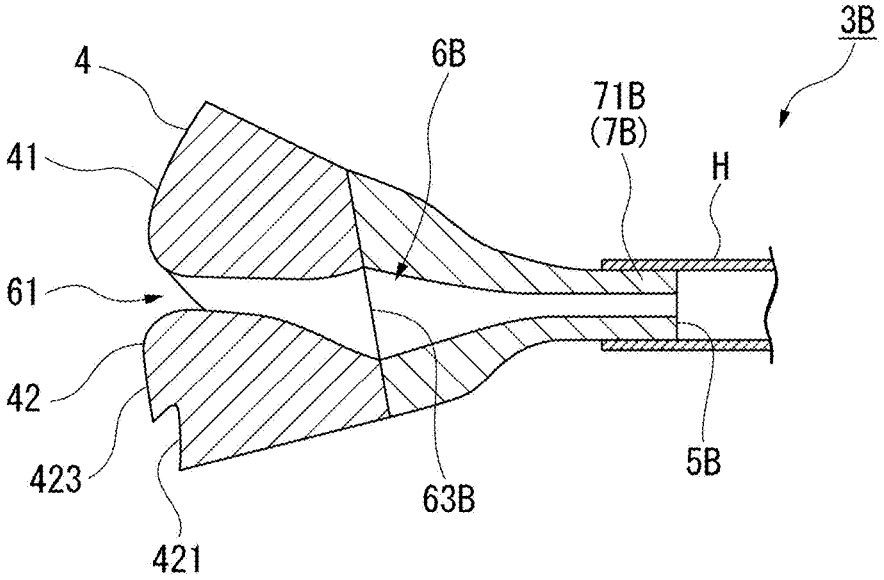
FIG. 8A is a cross-sectional view showing a performance support device.

As shown in FIG. 8A, a performance support device 3B is applied to the same flute MI as that shown in FIG. 1 and the like. The performance support device 3B includes a first surface 4, a second surface 5B, and a flow path 6B. The first surface 4 is positioned on the blow hole 12 side of the flute MI. The second surface 5B is positioned on the performer's lips side. The flow path 6B penetrates from the first surface 4 to the second surface 5B.

The first surface 4 is the same as that described earlier. The second surface 5B is formed in a flat shape in the same manner as that described earlier. However, the size (area) of the second surface 5B is smaller than that described earlier.

The cross-sectional area of the flow path 6B at the first surface 4 is smaller than the cross-sectional area of the flow path 6B at a position which is displaced from the first surface side 4 toward the second surface side 5B. However, the position at which the cross-sectional area of the flow path 6B in the penetration direction of the flow path 6B reaches a maximum is at an intermediate portion 63B of the flow path 6B in the penetration direction. That is to say, the cross-sectional area of the flow path 6B at the first surface 4 and the second surface 5B is smaller than the cross-sectional area at the intermediate portion 63B of the flow path 6B. Furthermore, the cross-sectional area of the flow path 6B is continuously increased from the first surface 4 of the performance support device 3B to the intermediate portion 63B of the flow path 6, and is continuously decreased from the intermediate portion 63B of the flow path 6B to the second surface 5B. The cross-sectional area of the flow path 6B at the second surface 5B may be larger or smaller than the cross-sectional area of the flow path 6B at the first surface 4. Moreover, the cross-sectional area of the flow path 6B at the second surface 5B may be substantially the same as the cross-sectional area of the flow path 6B at the first surface 4.

The cross-sectional shape of the flow path 6B may be formed with a flattened shape in the penetration direction from the first surface 4 through the intermediate portion 63B to the second surface 5B. However, in consideration of the attachment portion 7B described below, the cross-sectional shape of the flow path 6B at the second surface 5B and in the vicinity thereof is preferably formed in a shape in which the width dimension and the height dimension of the flow path 6B at the second surface 5B are equal to each other, or formed in a shape in which the difference between these dimensions is small. In this case, it is preferable that the flow path 6B be formed so that the cross-sectional shape of the flow path 6B continuously changes from the intermediate portion 63B toward the second surface 5B.

In the performance support device 3B, a part positioned on the second surface 5B side in the penetration direction is an attachment portion 7B for attaching a hose H. The attachment portion 7B is formed in a tubular shape. Specifically, the attachment portion 7B is an insertion portion 71B which is inserted inside the hose H. For this reason, it is preferable that the outer circumference of the insertion portion 71B be formed in a shape that corresponds to the shape (such as a circular shape) of the inner circumference of the hose H.

Consequently, the space inside the hose H can be connected to the flow path 6B of the performance support device 3B. Furthermore, the inner circumferential surface of the hose H can be brought into close contact with the outer circumferential surface of the insertion portion 71B. As a result, the performer's exhaled breath blown into the hose H can be inhibited or prevented from leaking from between the hose H and the performance support device 3B.

According to the performance support device 3B, the same advantageous effects as those described earlier can be obtained.

Furthermore, it is possible to attach a hose H to a part of the performance support device 3B positioned on the second surface 5B side. Consequently, the performer is capable of playing the flute MI by gripping the hose H by mouth. Accordingly, the flute MI can be played even if the performer's lips are not brought close to the blow hole 12 of the flute MI. Therefore, the performer is capable of playing the flute MI in various ways. For example, if an elastic hose H is used, unique performances can be performed because the performer's face can be freely moved with respect to the flute MI.

Figure 8B:
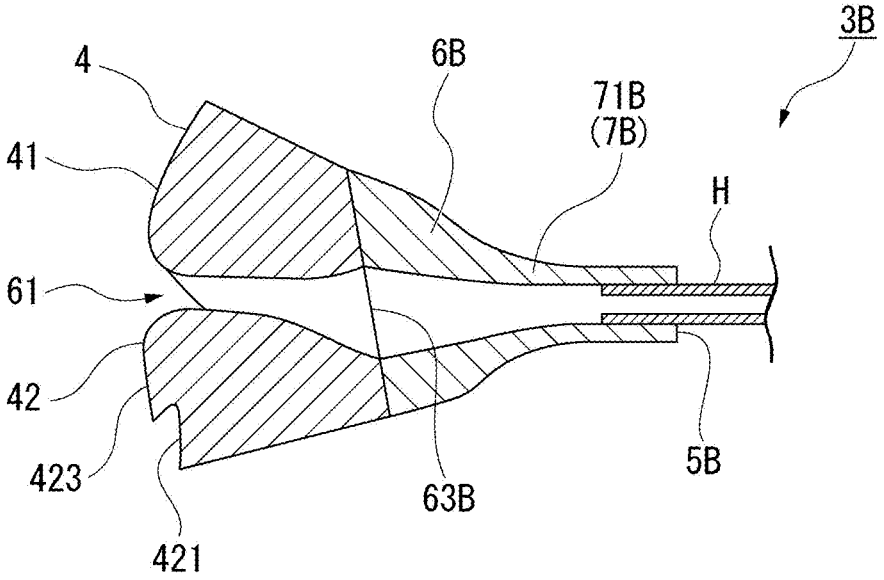
FIG. 8B is a cross-sectional view showing another performance support device.

The attachment portion 7B may, for example, be an insertion portion to insert the hose H into the flow path 6B, which is open at the second surface 5B (see FIG. 8B). In this case, it is preferable that the inner circumference of the insertion portion (that is to say, the inner surface of the flow path 6B) be formed in a shape that corresponds to the shape (such as a circular shape) of the outer circumference of the hose H.

The embodiments of the present invention have been described in detail above. However, the present invention is not limited to the embodiments above, and various changes may be applied within a scope not departing from the spirit of the present invention.

In some embodiments of the present invention, the cross-sectional area of the flow path may, for example, become discontinuously larger from the first surface of the performance support device toward the second surface. That is to say, a section on the first surface side of the flow path having a small cross-sectional area, and a section on the second surface side of the flow path having a large cross-sectional area may be connected in a stepped fashion.

In some embodiments of the present invention, the cross-sectional shape of the flow path is not limited to a flattened shape, and may be an arbitrary shape such as a circular shape or a square shape.

In some embodiments of the present invention, the performance support device may, for example, be formed so as to not be elastically deformable. The performance support device may be made of a material which is not elastically deformable or is not easily elastically deformed, such as metal or wood.

Figure 9:
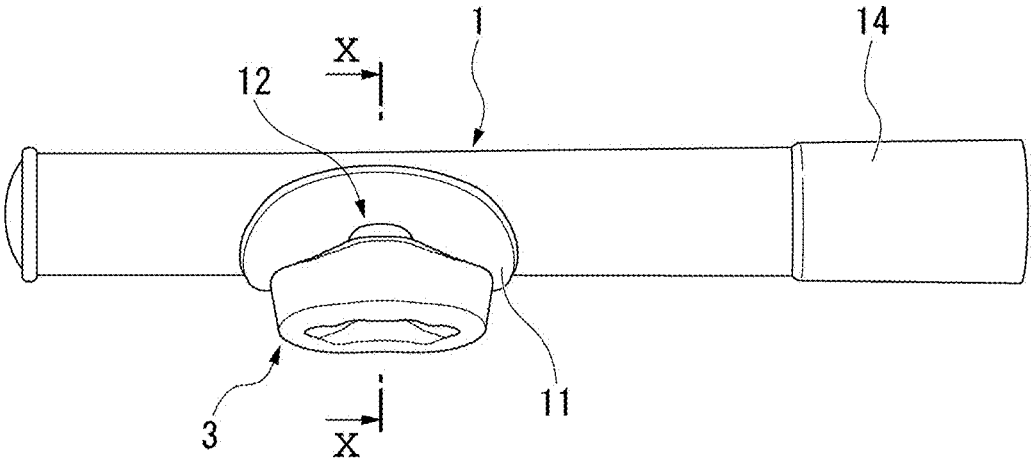
FIG. 9 is an external view showing a head tube integrally formed with a performance support device.
Figure 10:
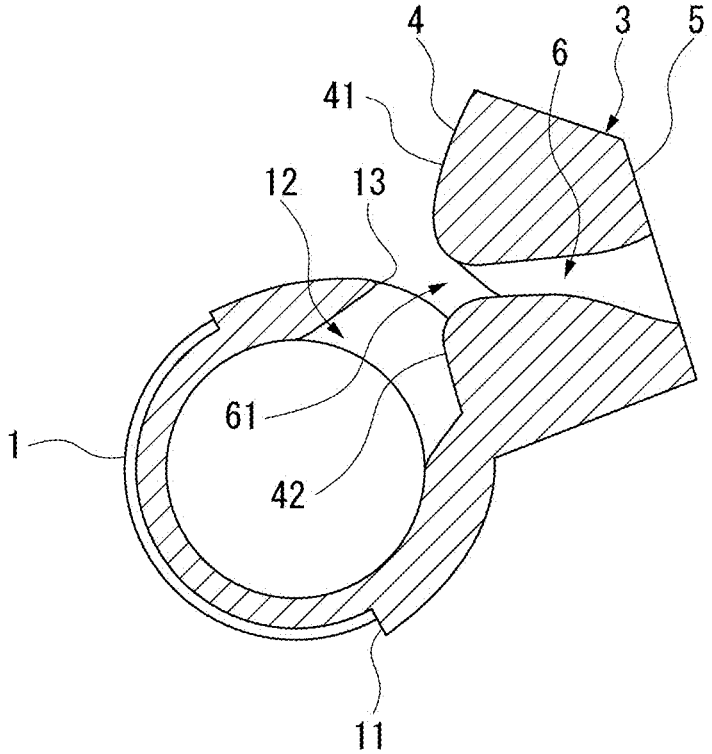
FIG. 10 is a cross-sectional view along arrows X-X in FIG. 9.

The performance support device of the embodiments of the present invention is not limited to being formed separately from the head tube of a flute. For example, as shown in FIGS. 9 and 10, the performance support device 3 may be integrally formed with the head tube 1. In FIG. 9, a first end portion 14 in the longitudinal direction of the head tube 1 (the horizontal direction in FIG. 9) is an attachment portion for attachment to a body tube (not shown) of the flute. When the performance support device 3 is integrally formed with the head tube 1, it is possible to easily configure a flute whose timbre is brought closer to the true timbre of the flute irrespective of the performer's playing skill by simply attaching a head tube 1 equipped with the performance support device 3 to the body tube of the flute instead of a head tube without the performance support device 3.

The performance support device of some embodiments of the present invention is applicable not only to flutes, but to other air reed instruments includes a head tube having a blow hole, such as piccolos, fifes, and shakuhachi flutes.

According to some embodiments of the present invention, it is possible to bring the timbre of an air reed instrument closer to the true timbre irrespective of a performer's playing skill.

What is claimed is:

1. A performance support device comprising:

a first surface configured to face a blow hole of an air reed instrument;

a second surface configured to be displaced from the blow hole; and a flow path that penetrates from the first surface to the second surface and that is configured to flow an exhaled breath toward the blow hole, wherein a cross-sectional area of the flow path at the first surface is smaller than a cross-sectional area of the flow path at a position displaced from the first surface toward the second surface.

2. The performance support device according to claim 1, wherein the cross-sectional area of the flow path continuously increases from the first surface toward the second surface.

3. The performance support device according to claim 1, wherein at least a portion of an edge of an opening of the flow path in the first surface is curved.

4. The performance support device according to claim 1, wherein the flow path has a shape that imitates lips of a performer.

5. The performance support device according to claim 1, wherein a part positioned on a side of the second surface is an attachment portion for attaching a hose.

6. The performance support device according to claim 5, wherein the attachment portion has a tubular shape, and is an insertion portion configured to be inserted inside the hose.

7. The performance support device according to claim 5, wherein the attachment portion is an insertion portion configured to insert the hose into the flow path from an opening in the second surface.

8. A performance support device according to claim 1, wherein the performance support device is elastically deformable.

9. An air reed instrument comprising:

a head tube including a blow hole; and a performance support device provided in a vicinity of the blow hole, the performance support device comprising:

a first surface configured to face the blow hole;

a second surface configured to be displaced from the blow hole; and a flow path that penetrates from the first surface to the second surface and that is configured to flow an exhaled breath toward the blow hole, wherein a cross-sectional area of the flow path at the first surface is smaller than a cross-sectional area of the flow path at a position displaced from the first surface toward the second surface.

10. The performance support device according to claim 1, wherein the first surface has an upper lip area that corresponds to an outer surface of an upper lip and has a convex curved surface and a lower lip area that corresponds to an outer surface of a lower lip, has a convex curved surface, and are arranged side-by-side with the upper lip area in a height direction of the flow path.

* * * * *